US009539169B2

(12) United States Patent
Pollack

(10) Patent No.: US 9,539,169 B2
(45) Date of Patent: Jan. 10, 2017

(54) DEVICE FOR EROTIC SELF-STIMULATION USING RUNNING WATER, AND A METHOD FOR ITS USE

(71) Applicant: Maureen Pollack, Stamford, CT (US)

(72) Inventor: Maureen Pollack, Stamford, CT (US)

( * ) Notice: Subject to any disclaimer, the term of this patent is extended or adjusted under 35 U.S.C. 154(b) by 69 days.

(21) Appl. No.: 14/159,581

(22) Filed: Jan. 21, 2014

(65) Prior Publication Data

US 2015/0018608 A1 Jan. 15, 2015

Related U.S. Application Data

(60) Provisional application No. 61/843,696, filed on Jul. 8, 2013.

(51) Int. Cl.
*A61H 19/00* (2006.01)
*A61H 9/00* (2006.01)

(52) U.S. Cl.
CPC ..... *A61H 19/34* (2013.01); *A61H 9/0028* (2013.01)

(58) Field of Classification Search
CPC A61H 19/44; A61H 19/34; A61H 2201/0153; A61H 19/32; A61H 19/50; A61H 19/40; A61H 23/00; A61H 2201/165; A61H 19/30; A61H 19/00; A61H 9/0028
See application file for complete search history.

(56) References Cited

U.S. PATENT DOCUMENTS

| | | | | |
|---|---|---|---|---|
| 6,315,220 | B1 * | 11/2001 | Grubb | 239/588 |
| 2007/0225548 | A1 | 9/2007 | Stelly | |
| 2013/0046136 | A1 * | 2/2013 | Enlow | 600/38 |

* cited by examiner

*Primary Examiner* — Christine H Matthews
(74) *Attorney, Agent, or Firm* — Law Office of Ilya Libenzon

(57) ABSTRACT

A water-based erotic stimulation device is disclosed, including a fastener and a chute with a faucet end and a distal end, and having a first portion and a second portion. The second portion is substantially horizontal. The distal end may have a groove, a water flow adjustment peg, or an extension, which may have adjustable length. The angle of the chute may be adjusted by adjusting the fastener. A method is also disclosed for using the device for erotic self-stimulation by attaching it to a faucet and directing its water toward the clitoral area of a woman using the device.

12 Claims, 8 Drawing Sheets

DEVICE FOR EROTIC SELF-STIMULATION USING RUNNING WATER, AND A METHOD FOR ITS USE

RELATED APPLICATION DATA

This application claims the benefit of U.S. Provisional Application No. 61/843,696, filed on Jul. 8, 2013, the entirety of which is incorporated herein by reference.

TECHNICAL FIELD

This invention relates generally to erotic self-stimulation devices generally, and to the use of running water for erotic self-stimulation in particular.

BACKGROUND ART

A popular method for erotic self-stimulation among women involves positioning the genital area beneath a running bathwater tap. The water can stimulate the clitoris and labial area, and the resulting stimulation can bring some women to orgasm. Unfortunately, the difficulty of positioning the genital area correctly beneath the flowing water can make this technique less than desirable for some women, as it requires a somewhat cramped and contorted position of the body; for those with limited flexibility or back problems, the physical difficulties attendant to positioning may make this approach to self-stimulation impossible.

Therefore, there remains a need for an erotic self-stimulation device that permits more comfortable use of bath water for autoerotic purposes.

SUMMARY OF THE EMBODIMENTS

Disclosed is an erotic self-stimulation device. The device includes a fastener for attaching the device to a faucet, and a chute for guiding the flow of water from the faucet in a substantially horizontal direction, the chute having a faucet end and a distal end, and including (i) a substantially vertical first portion located beneath the faucet opening, and (ii) a substantially horizontal second portion continuously fixed to the end of the first portion.

In a related embodiment, the fastener includes a push-fastener system that encircles the faucet. In an additional embodiment, the fastener includes a substantially horizontal extension to the faucet end of the chute. In another embodiment, the fastener may be adjusted to change the angle of the second portion of the chute. In still another embodiment, the chute also includes a projecting lip at its distal end. The chute additionally includes a groove in its distal end for concentrating the flow of water, in another embodiment. Still another embodiment includes a flow adjustment peg, attached to the distal end of the chute, for modifying the water flow. In an additional embodiment, the flow adjustment peg is detachable from the distal end of the chute. In yet another embodiment, the flow adjustment peg has the form of a hemisphere with its equator against the upper surface of the distal end of the chute. In another embodiment, the flow adjustment peg has the form of a convex paraboloid of revolution. In another embodiment still, the flow adjustment peg has two peaks separated by a valley. Yet another embodiment includes a chute extension attached to the distal end of the chute. The chute extension has an adjustable length in another embodiment. In an additional embodiment, the chute extension includes a sleeve fitted around the exterior surface of the chute near to its distal end.

A method is also described for erotic self-stimulation, including providing a device as described above, attaching the device to a faucet in a bathtub using the fastener, and directing, using the device, water from the faucet to the clitoral area of a woman in the bathtub.

A related embodiment of the method involves adjusting the direction of flow of the water by adjusting the fastener of the device to change the angle of the chute.

Other aspects, embodiments and features of the device and method will become apparent from the following detailed description of the device and method when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the following detailed description of the device and method, will be better understood when read in conjunction with the attached drawings. It should be understood that the device and method are not limited to the precise arrangements and instrumentalities shown.

DETAILED DESCRIPTION OF SPECIFIC EMBODIMENTS

Embodiments of the disclosed device and method take the discomfort out of bathtub tap-water masturbation. In some embodiments, the chute directs the flow of the water in a more ergonomically feasible direction, and transfers it to the middle of the tub where the relatively greater space allows for more flexibility for the user. The angle of the chute may be adjusted in some embodiments; further fine-tuning may be possible using various extensions to the end of the device.

Figure 1:
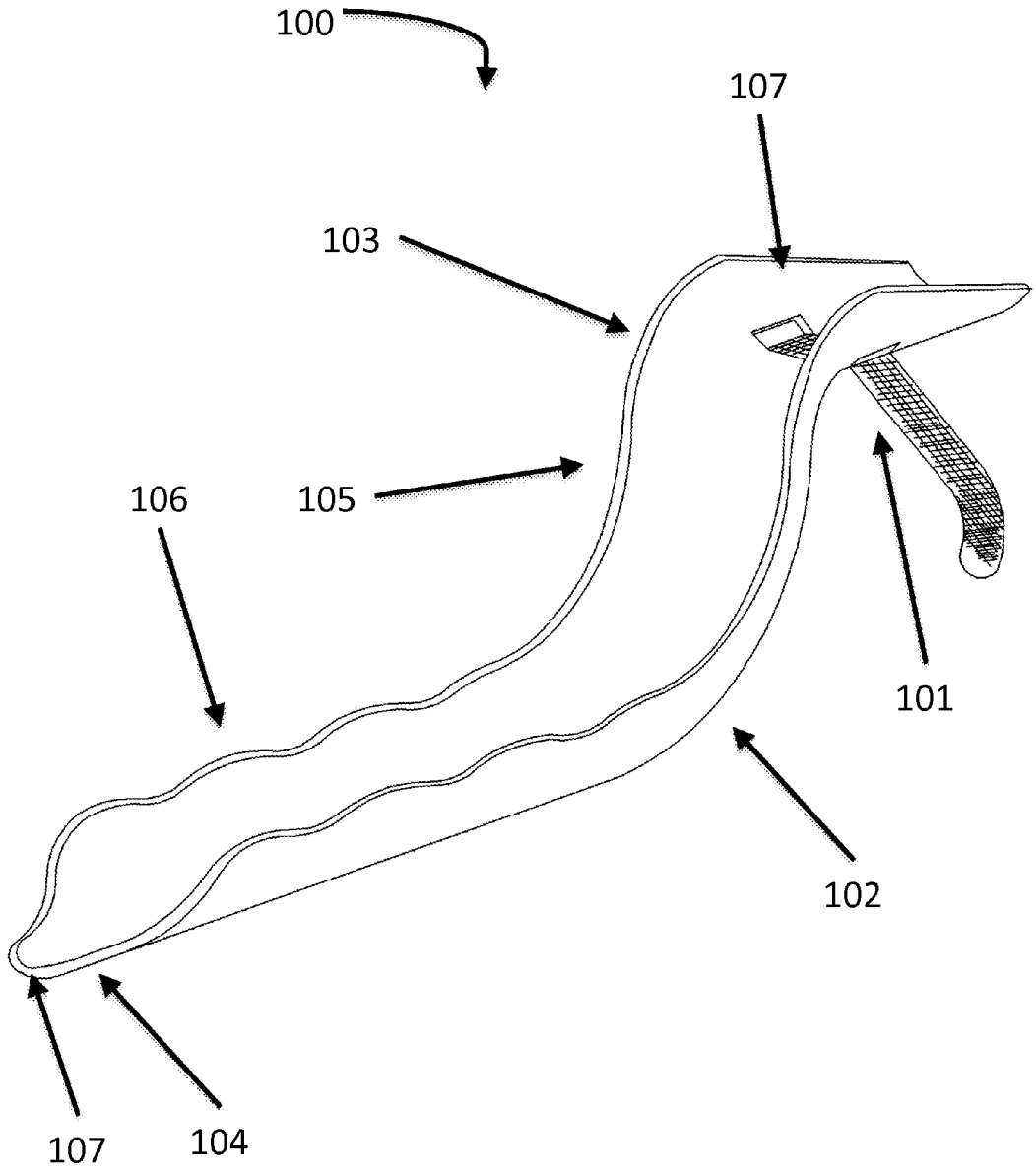
FIG. 1 is a schematic diagram illustrating one embodiment of the disclosed device.

FIG. 1 depicts one embodiment of erotic self-stimulation device 100. The device 100 includes a fastener for attaching the device to a faucet 101. The device 100 also includes a chute 102 for guiding the flow of water from the faucet in a substantially horizontal direction, the chute having a faucet end 103 and a distal end 104, and comprising (i) a substantially vertical first portion 105 located beneath the faucet opening, and (ii) a substantially horizontal second portion 106 continuously fixed to the end of the first portion 105.

The fastener 101 attaches the device 100 to the faucet. In some embodiments, the fastener 101 includes a push-fastener system that encircles the faucet. In one embodiment, a push-fastener system is a fastener made up of one or more strips material, two surfaces of which are so formed that they mate when pressed together. The push-fastener system may be made up of hook and loop strips, such as the VELCRO product of Velcro Industries B.V., Castorweg 22-24, Curacao, Netherlands, wherein one surface is covered with minute hooks, and another surface is covered by minute loops, so that when the two surfaces are pressed together, the hooks snag in the loops, locking the two surfaces together. The push-fastener system may involve one or more are slidingly engaged fasteners, such as DUAL LOCK of 3M Company Corporation, located at 2501 Hudson Road, St. Paul, Minn. 55144, which have surfaces covered by protrusions that flange at their distal ends, so that when pressed against another such surface, the flanged ends engage one another, locking the two surfaces together. In other embodiments, the push-fastener system mates surfaces by bringing minute surface elements into very close electrostatic contact, for instance by mimicking the adhesive foot structures of geckos or tarantulas. The fastener 101 may function by engaging a pin or prong on one strip surface in a hole on another strip surface. In some embodiments, the fastener 101 includes at least one screw. The screw may tighten the fastener. The screw may secure the fastener. In other embodiments the fastener includes an adhesive. The adhesive may be pressure-sensitive.

The fastener 101 may include a snap. In some embodiments, the fastener 101 includes a buckle. The fastener 101 may include a cam buckle. The fastener 101 may include a spring buckle. The fastener 101 may include a slide release buckle. The fastener 101 may include a double-loop frame style buckle. The fastener 101 may include a single-loop frame style buckle. The fastener 101 may include a prong frame-style buckle. The fastener 101 may include a plate buckle. The fastener 101 may include a box-out buckle. The fastener 101 may include a clip buckle. The fastener 101 may include a snap buckle. The fastener 101 may include a clasp. The fastener 101 may include a tension lock. The fastener 101 may include a ladder lock. The fastener 101 may include a tri glide. The fastener 101 includes a hook-and-eye fastener in some embodiments. The fastener 101 may include a magnetic attachment device. The fastener 101 may include a drawbolt catch-fastener, which uses a small lever to pull a wire bail or similar structure around a hook or grooved element that may additionally mate with the element bearing the lever; the lever may snap securely into position once the bail is tightened around the hook or grooved element, in some cases by having a resting position just beyond the point of maximum tension, so that the tension on the bail holds the lever in its closed position.

The fastener 101 may include one or more strips of flexible material; for instance, the fastener 101 may include one or more strips of flexible material faced with push fastener surfaces, so that the fastener attaches to a faucet by encircling the faucet with the at least one strip and mating the push fastener surfaces to fix the at least one strip in the encircling position. The fastener 101 may include at least one strap. The straps may be leather. The straps may be rubber. The straps may be composed of a flexible polymer. The straps may be composed of natural textile. The straps may be cotton; for instance, the straps may be canvas. The straps may be flax. The straps may be hemp. The straps may be Manila hemp. The straps may be silk. The straps may be animal hair, such as wool. The straps may be composed of a synthetic textile. The straps may be nylon. The straps may be polypropylene. The straps may be polyester. In some embodiments, the straps are composed of flat webbing. In other embodiments, the straps are composed of tubular webbing.

The fastener may include one or more rigid elements; for example, the fastener may a rigid element that may be placed on one side of the faucet while the chute 102 is placed on the other side, and then fixed to the chute 102 so as to clamp the faucet between the rigid element and the chute 102. The fastener 101 may include one or more semi-flexible straps. As an example, the fastener 101 may include a strap of metal such as steel, which encircles the faucet and may be tightened by a screw, in the manner of a hose clamp. In some embodiments, the fastener includes a substantially horizontal extension 107 to the faucet end of the chute, and formed to fit against the underside of the faucet. Rigid and semi-rigid elements of the fastener 101 may be composed of any material of sufficient durability, hardness, and elasticity to perform the structural requirements of that type of fastener 101. The rigid elements may be metal. The rigid elements may be composed of a hard polymer such as plastic.

In some embodiments, the fastener may be adjusted to change the angle of the second portion of the chute. Some fasteners 101, such as the double loop buckle or ladder lock, are inherently adjustable. Likewise, a push-fastener may be adjusted by disengaging the fastener, shifting the mating surfaces in relation to each other, and then reengaging the fastener. A fastener 101 that is not adjustable inherently may be made adjustable by including an adjustable form in its design. For example, either the male or female half of a slide-release buckle may be fused to a tension lock through which a strap is threaded, making the slide-release buckle adjustable.

The device 100 also includes a chute 102. The chute 102 may be constructed of any material suitable for the construction of a rigid portion of the fastener 101, as described above in reference to FIG. 1. The chute 102 may be composed of any combination of materials suitable for the construction of a rigid portion of the fastener 101. The chute 102 may be constructed of any flexible material. The chute 102 may be composed of any combination of flexible and rigid materials. In one embodiment, the second portion of the chute 106 is continuously fixed to the first portion 105 if the two portions combine to form a chute 102 with a single, uninterrupted channel, such that the water from the faucet flows from the first portion 105 through the second portion 106 in a largely unimpeded manner, aside from a change in direction. The first portion 105 may be attached to the second portion 106. The first portion 105 and second portion 106 may be joined by a hinge, such as an accordion hinge. The first portion 105 may be fused to the second portion 106. The first portion 105 and second portion 106 may form a single monolithic unit; for example, the chute 102 may be composed of a single piece of hard plastic.

Figure 2:
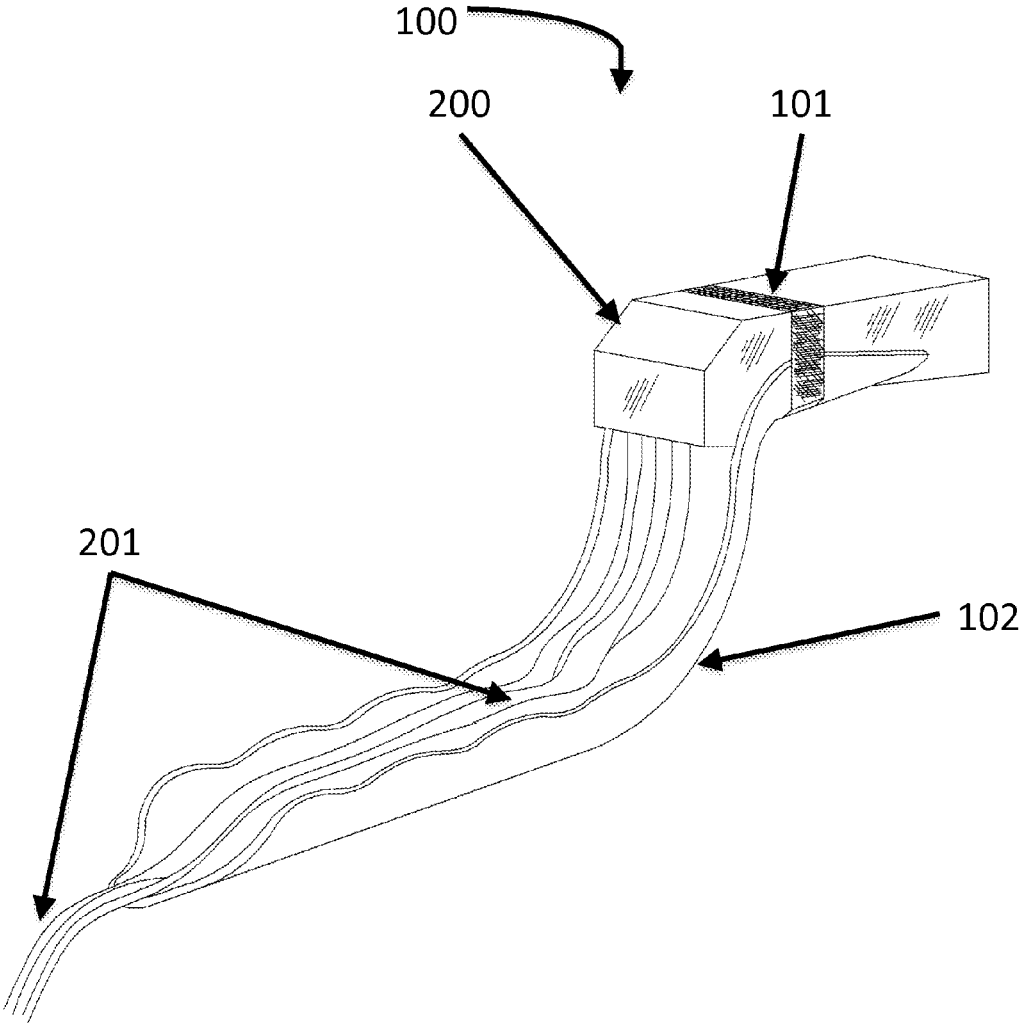
FIG. 2 is a schematic diagram showing an embodiment of the disclosed device connected to a faucet.

FIG. 2 illustrates one embodiment of the device 100 attached to a faucet 200 using the fastener 101, with water 201 flowing through the chute 102 and out of its distal end 104. In some embodiments, the angle of the chute 102 is adjustable. A portion of the chute 102 may be constructed of a material that is sufficiently flexible for the user to bend it to describe a desired angle or curve. The material may also be constructed to retain a shape into which it is formed. The material may be sufficiently resistant to deformation to hold the shape into which a user forms it to adjust the angle or curvature of the chute 102. For example, the chute 102 may be partially composed of metal wires, which may be bent into particular shapes along with the chute, holding it in a new deformed shape, and resisting the effect of the water 201 to change the deformed shape. A portion of the chute 102 may be hinged. The hinge may be constructed of any materials described above in reference to FIG. 1 as suitable for the creation of the chute. The hinge may be any form of hinge that enables the angle of the chute to be adjusted while also allowing water to flow through the chute. For instance, the hinge may be an accordion hinge located at any point on the chute. The hinge may be an accordion hinge with a smooth lining to aid in the unimpeded flow of water. The hinge may be a hinge that introduces a discontinuity in the chute 102 at a location where the flow of the water is substantially unaffected. For instance, the hinge may introduce a discontinuity near the faucet end 103 of the chute 102, such that the water 201 is flowing in a substantially vertical direction at the point of the discontinuity.

Figure 3:
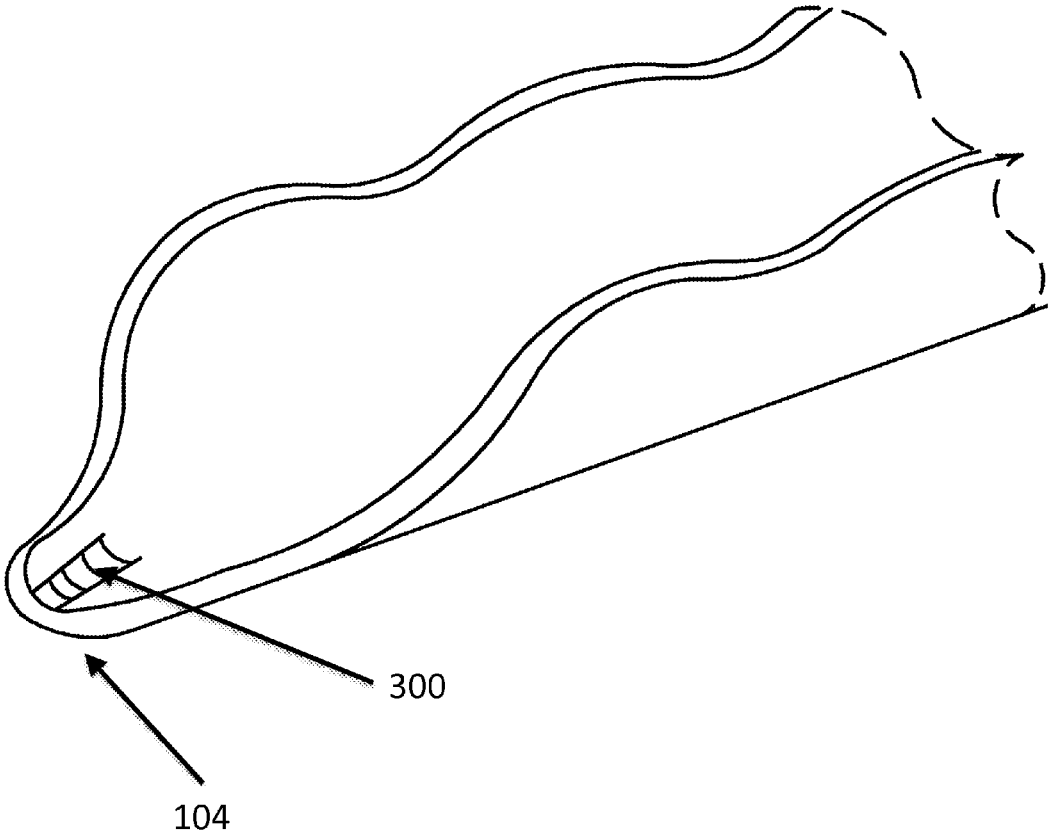
FIG. 3 is a schematic diagram showing one embodiment of the distal end of the disclosed device with a water flow concentration groove.
Figure 4A:
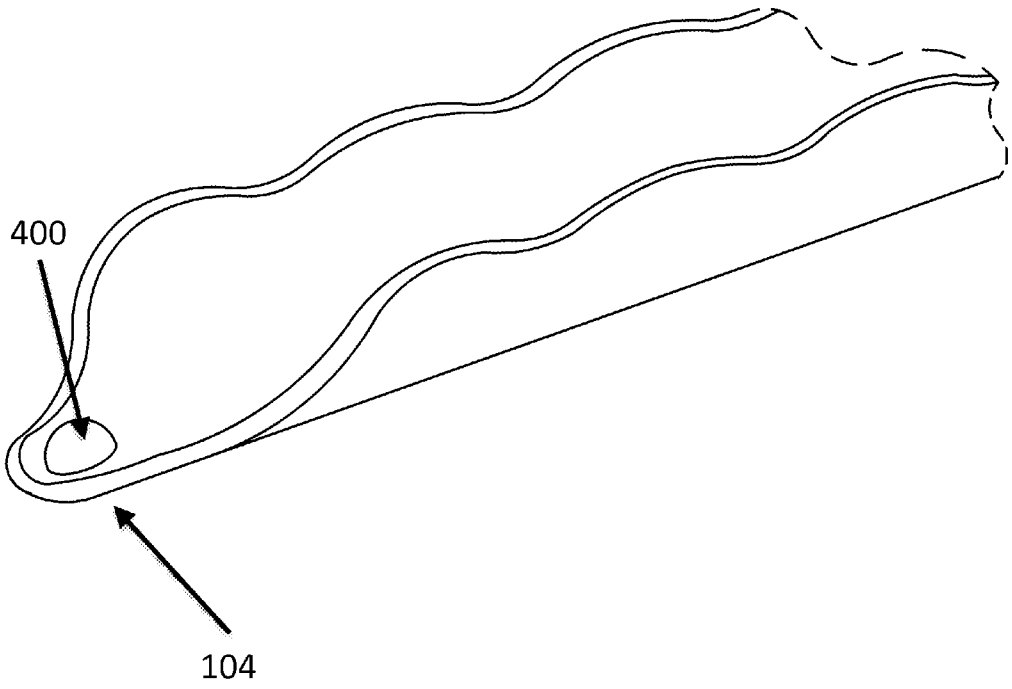
FIG. 4A is a schematic diagram showing one embodiment of the distal end of the disclosed device with a flow adjustment peg.
Figure 4B:
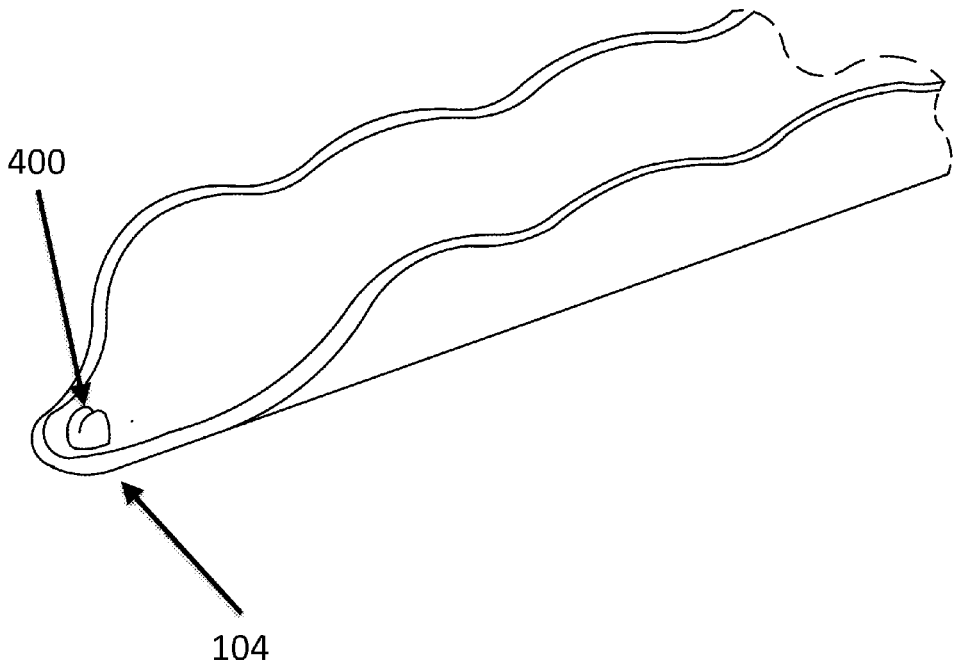
FIG. 4B is a schematic diagram showing one embodiment of the distal end of the disclosed device with a flow adjustment peg.

In some embodiments, as illustrated in FIG. 1, the chute 102 further includes a projecting lip 107 at its distal end. The projecting lip 107 may be attached to the distal end 104. The projecting lip 107 may be fused to the distal end 104. The projecting lip 107 and distal end 104 may form a single, monolithic unit. FIG. 3 illustrates an embodiment of the device 100 in which the chute also includes a groove 300 in its distal end for concentrating the flow of water. As illustrated in FIG. 4A, the device 100 may also include a flow adjustment peg 400, attached to the distal end of the chute 104, for modifying the water flow. The flow adjustment peg 400 may be fused to the distal end 104. The flow adjustment peg 400 and the distal end 104 may form a single monolithic unit. The flow adjustment peg 400 may be detachable from the distal end of the chute 104. In one embodiment, the peg 400 is detachable from the distal end of the chute 104 if it may be detached and reattached an indefinite number of times, and used subsequent to reattachment with no loss of function. In some embodiments, the flow adjustment peg 400 has the form of a hemisphere with its equator against the upper surface of the distal end of the chute. In other embodiments, the flow adjustment peg 400 has the form of a convex paraboloid of revolution. In still other embodiments, as illustrated in FIG. 4B, the flow adjustment peg 400 has two peaks separated by a valley. In some embodiments, where the flow adjustment peg 400 is detachable, the flow adjustment peg 400 is one of a plurality of flow adjustment pegs 400 that may be interchanged with one another to achieve a desired effect. Each of the plurality of flow adjustment pegs 400 may have a different form, including any of the forms just described.

Figure 5A:
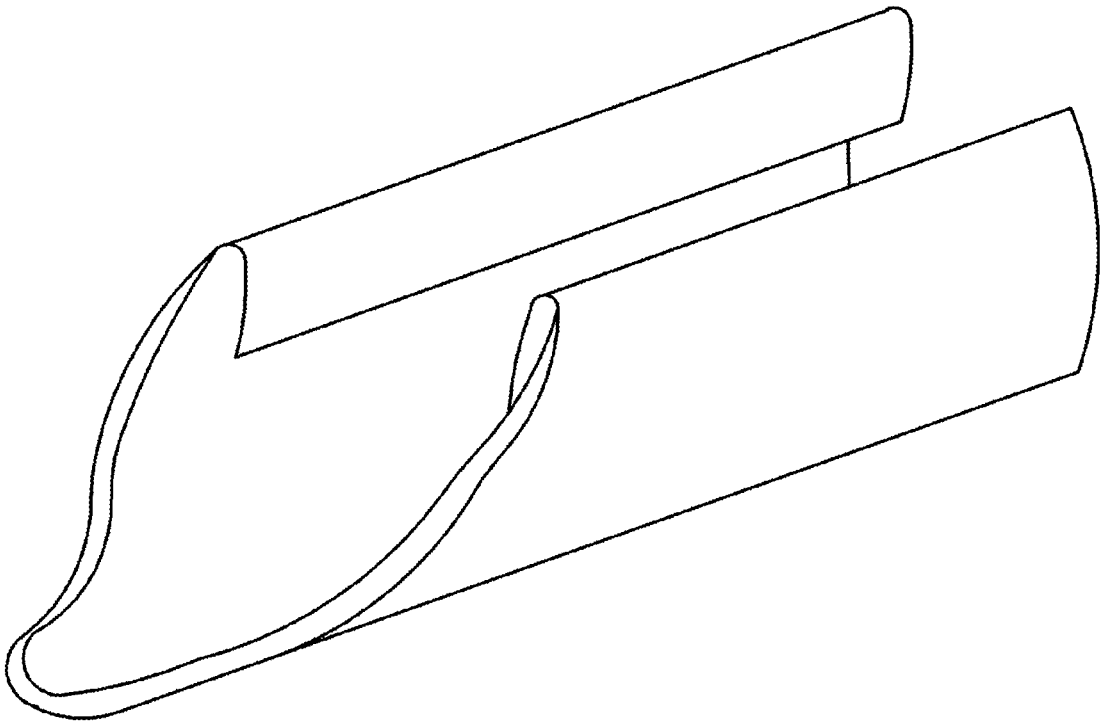
FIG. 5A is a schematic diagram showing one embodiment of an extension for the distal end of the disclosed device.
Figure 5B:
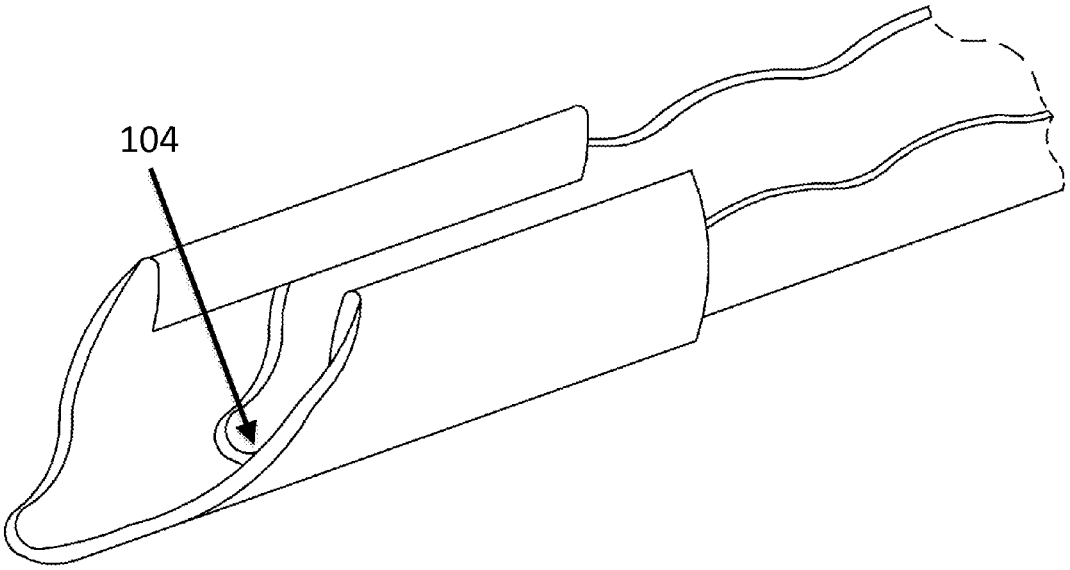
FIG. 5B is a schematic diagram showing one embodiment of the distal end of the disclosed device with an extension.

In some embodiments, as illustrated in FIG. 5A and 5B, the device 100 includes a chute extension 500 attached to the distal end 104 of the chute. The extension 500 may form a sleeve that can be slipped over the distal end 104 of the chute. The extension 500 may be formed to slide inside the distal end 104 of the chute. In some embodiments, the extension 500 may be fixed to the distal end 104 of the chute; for instance, the extension 500 may be fastened to the distal end 104 of the chute by any fastener 101 described above in reference to FIG. 1. In some embodiments, the chute extension 500 has an adjustable length. For instance, where the chute extension 500 is a sleeve that slips over the distal end 104, or where the chute extension 500 is formed to slide inside the distal end, 104 the length of the extension 500 may be increased by sliding it away from the faucet end 103 of the chute and toward the user. The length of the extension 500 may be decreased by sliding the extension 500 toward the faucet end 103 of the chute, and away from the user, in other embodiments. The extension 500 may be collapsible. For instance, it may have a portion in an accordion form that can be collapsed to shorten its length; the collapsing may be reversed to lengthen the extension 500. In other embodiments, the extension 500 may telescope. For example, the extension 500 may be formed of several overlapping sleeve portions that can overlap more or less to change the length of the extension.

Figure 6:
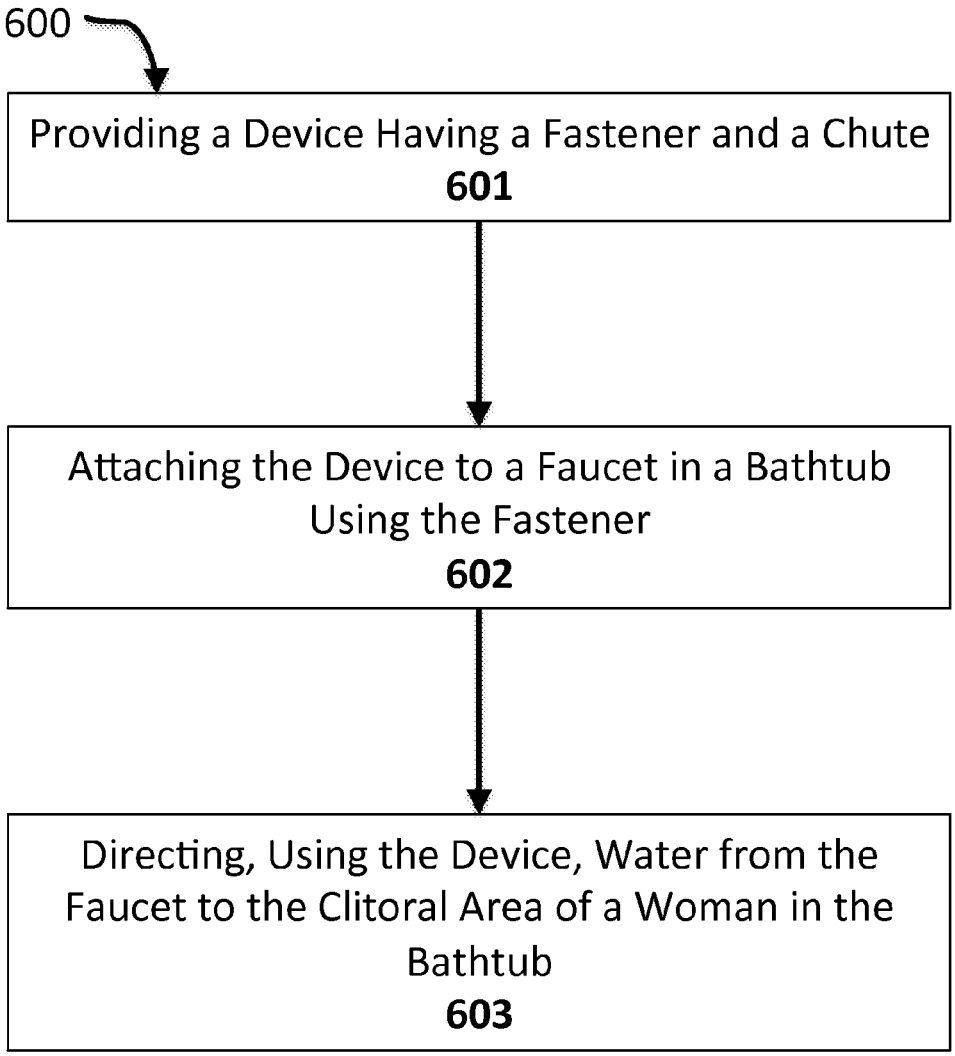
FIG. 6 is a flowchart depicting one embodiment of a method for erotic self-stimulation using the disclosed device.

FIG. 6 is a flow chart depicting a method 600 for erotic self-stimulation. The method 600 includes providing a device as described above in reference to FIG. 1 (601). The method 600 includes attaching the device to a faucet in a bathtub using the fastener (602). The method 600 includes directing, using the device, water from the faucet to the clitoral area of a woman in the bathtub (603). In some embodiments, the method further includes adjusting the direction of flow of the water by adjusting the fastener of the device to change the angle of the chute 102. In other embodiments, the method further includes attaching a chute extension 500 to the chute 102 at its distal end 104. The method may include adjusting the length of the chute extension 500. The method may include attaching a flow adjustment peg 400 to the distal end of the chute 104. The method may include detaching the flow adjustable peg 400 from the distal end of the chute 104 and attaching a second flow adjustment peg 400 to the distal end of the chute.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An erotic self-stimulation device, the device comprising:

a fastener for attaching the device to a faucet having a faucet opening;

a chute for guiding the flow of water from the faucet in a substantially horizontal direction, the chute having a concave upper surface over which the water from the faucet flows, the concave upper surface forming a trough through which the water from the faucet flows, the chute further comprising a lower surface, a faucet end, and a distal end having a projecting lip, the chute further comprising (i) a substantially vertical first portion located beneath the faucet opening, the first portion having an end, and (ii) a substantially horizontal second portion continuously fixed to the end of the first portion; and a chute extension attached to the distal end of the chute, the chute extension comprising a sleeve fitted around the lower surface of the chute near to the distal end of the chute.

2. A device according to claim 1, wherein the fastener comprises a push-fastener system that encircles the faucet.

3. A device according to claim 1, wherein the fastener comprises a substantially horizontal extension to the faucet end of the chute.

4. A device according to claim 1, wherein the fastener may be adjusted to change an angle of the second portion of the chute.

5. A device according to claim 1, wherein the chute further comprises a groove in its distal end for concentrating the flow of water.

6. A device according to claim 1, further comprising a flow adjustment peg, attached to the distal end of the chute, for modifying the water flow.

7. A device according to claim 6, wherein the flow adjustment peg is detachable from the distal end of the chute.

8. A device according to claim 6, wherein the flow adjustment peg has the form of a hemisphere with its equator against the upper surface at the distal end of the chute.

9. A device according to claim 6, wherein the flow adjustment peg has two peaks separated by a valley.

10. A device according to claim 1, wherein the chute extension has an adjustable length.

11. A method for erotic self-stimulation, the method comprising:

providing a device according to claim 1;

attaching the device to a faucet in a bathtub using the fastener; and directing, using the device, water from the faucet to a clitoral area of a woman in the bathtub.

12. A method according to claim 11, further comprising adjusting the direction of flow of the water by adjusting the fastener of the device to change an angle of the chute.

* * * * *